United States Patent [19]

Okamoto et al.

[11] 4,168,948

[45] Sep. 25, 1979

[54] BURNER ASSEMBLY

[75] Inventors: Toshimasa Okamoto, Kaji; Shohachiro Shimpo, Chigasaki; Ryoetsu Kikuchi, Yachiyo; Fumio Ikeda, Kawaguchi, all of Japan

[73] Assignee: Kabushiki Kaisha Tomoe Shokai, Tokyo, Japan

[21] Appl. No.: 785,311

[22] Filed: Apr. 6, 1977

[30] Foreign Application Priority Data

Apr. 8, 1976 [JP] Japan ..... 51-39664

[51] Int. Cl.[2] ..... F23D 13/12; F23D 13/00

[52] U.S. Cl. ..... 431/114; 181/229; 431/265

[58] Field of Search ..... 431/114, 346, 265, 2; 181/224, 252, 241, 248; 123/52 M

[56] References Cited

U.S. PATENT DOCUMENTS

| | | | |
|---|---|---|---|
| 2,046,193 | 6/1936 | Spicer | 181/252 |
| 2,150,782 | 3/1939 | Vollmer | 431/114 |
| 2,670,034 | 2/1954 | Thompson | 431/114 |
| 2,942,683 | 6/1960 | Moyer | 181/229 |
| 2,955,671 | 10/1960 | Leistritz | 181/229 |
| 3,712,416 | 1/1973 | Swanson | 181/229 |
| 3,940,234 | 2/1976 | Reed | 431/114 X |

FOREIGN PATENT DOCUMENTS

| | | | |
|---|---|---|---|
| 1009429 | 5/1957 | Fed. Rep. of Germany | 123/52 M |
| 891757 | 3/1962 | United Kingdom | 181/229 |

*Primary Examiner*—Harold W. Weakley
*Attorney, Agent, or Firm*—Fleit & Jacobson

[57] ABSTRACT

In a burner assembly connected with a combustion chamber at a fuel inlet of said combustion chamber, the improvement of which comprising a fuel duct which is connected at its one end to said fuel inlet and contains therein a fuel injection nozzle, ignition rod and air-fuel mixture diffuser, a blower means which has an outlet for blowing an air through said outlet of the blower means and said fuel duct into said combustion chamber, and a conduit member coupled to said inlet of the blower means, whereby pneumatic oscillation plane progressive waves are converted into plane stationary waves to thereby reduce progressive energy of said pneumatic oscillation plane progressive waves.

5 Claims, 11 Drawing Figures

BURNER ASSEMBLY

BRIEF SUMMARY OF THE INVENTION

The present invention relates in general to a burner assembly or combustor assembly for a boiler or steam generator, and more particularly to a burner assembly capable of preventing progressive energy of a pneumatic oscillation plane progressive waves from adversely affecting an operation of a principal mechanism provided in the inside of a burner body and aiding in balancing distribution of the resultant energy, and still more particularly to a burner assembly for providing an efficient combustion system.

There will be discussed in the first place a conventional prior art burners and various effects of the progressive energy of pneumatic oscillation plane progressive waves of complicated frequencies due to their burning sound upon an operation of the main burner mechanism, with reference to FIG. 1(*a*) which, though, shows the present invention.

Referring to FIG. 1(*a*), fuel, such as gas or oil, is injected from a nozzle 4, and a combustion air is supplied in the direction of arrow "R" by driving a fan or blower 3 and gyratorily agitated by a diffuser 6 into air-fuel mixture particles, which are then issued into a furnace 11 through a fuel inlet 7 in the direction of arrow"S." When the air-fuel mixture particles are ignited by a ignition rod 5, the air-fuel mixture particles form a flame, which is denoted by "X," in front of the fuel inlet 7 and are violently burnt within the furnace 11 while producing pneumatic oscillations, denoted by "Y," at complicated frequencies due to the combustion sound. The pneumatic oscillations (Y) resonate by reflection at the inner walls of the furnace 11, thus extremely increasing the sound pressure within the furnace 11, that is, the amplitude of the pneumatic oscillations.

The pneumatic oscillations (Y) at complicated frequencies produced within the furnace 11 due to the sound of combusion proceeds in the form of pneumatic oscillation plane progressive waves, designated by "Z," from the fuel inlet 7 through a fuel duct 1 and the burner body 1, that is, through diffuser 6, nozzle 4, ignition rod 5 and blower 3, in the direction opposite to the stream line of the air fuel mixture particles, which is shown by "S," and in the direction opposite to the direction of supply of combustion air (R) and is propagated from an inlet 8 into atmosphere. Thus, the air-fuel mixture particles issued into the front of the fuel inlet 7 are partly pushed back through a flame inlet 2 into the burner body 1 by the progressive energy of the pneumatic oscillation plane progressive waves (Z), to float and be attached to stain the rear surface of the diffuser 6 and inner surface of the ignition rod 5, nozzle 4 and ignition tube 2. Thus, the form of injection of fuel from the nozzle 4 is disturbed, namely, the fuel injection is deformed, preventing a desirable ignition of the ignition rod 5 and presenting an outcome of various troubles. In addition, the air-fuel mixture particles are partly ignited by the combustion flame (X) in front of the flame inlet 7, thus giving rise to the so-called "flashback."

Further, the progressive energy of the pneumatic oscillation plane progressive waves at complicated frequencies due to combustion sound proceeds in the direction opposite to the streamline of air from the blower 3, as shown by "R." Thus, not only the efficiency of air supply from the blower 3 is extremely reduced but also in case where a small-size, low-pressure fame or blower is used, the phenomenon of breathing of an air supply takes place, ultimately resulting in breathing combustion and oscillational combustion to render a continuous normal combustion impossible.

Furthermore, the pneumatic oscillation plane progressive waves, which are of complicated frequencies due to the combustion sound, are directly propagated from the air inlet 8 into the room where the burner is installed, thus giving rise to various drawbacks such as generation of a great noise and resonation of doors and windows of the room.

In view of the above, in order to prevent as much as possible pneumatic oscillations (Y) at complicated frequencies due to combustion sound from entering the burner body 1 and fuel duct 2 in the form of the pneumatic oscillation plane progressive waves (Z), the conventional burner has adopted a structure where an area of communication of the furnace 11 with respect to burner body 1 and fuel duct 2 is extremely reduced by building the fuel inlet 7 smaller or the diffuser 6 larger. With such structure of the conventional burner, where the resistance against the flow of air adjacent the tip of the fuel duct 2 is constructed in an extremely large scale, a blower of large size and capable of producing high pressure is required. This means that the speed of jet of air-fuel mixture particles and speed of combustion air are unnecessarily increased adjacent to the tip of the fuel duct 2, thus extremely increasing the combustion speed and causing more violent combustion sound to be generated. In other words, continuation of the undesired cycle of air supply pressure and combustion sound tends to cause progressive increase of the size and pressure of the blower.

Accordingly, an object of the present invention is to basically preclude the various drawbacks inherent in the prior-art burner by means of a very simple mechanism.

Another object of the present invention is to provide a burner assembly which allows a continuation of normal combustion with a normal form of fuel injection from a nozzle.

Another object of the present invention is to provide a burner assembly which provides an efficient combustion system without so-called flashback.

Another object of the present invention is to provide a burner assembly which allows an efficient combusion by a smaller blower.

Further object of the present invention is to provide a burner assembly, which is compact, simple in structure and reliable in its operation.

Additional object of the present invention is to provide a burner assembly which prevents the generation of violent sound of combustion.

Other objects and features of the present invention will become apparent from the following detailed description of specific embodiments thereof.

DETAILED DESCRIPTION OF THE INVENTION

Figure 1A:
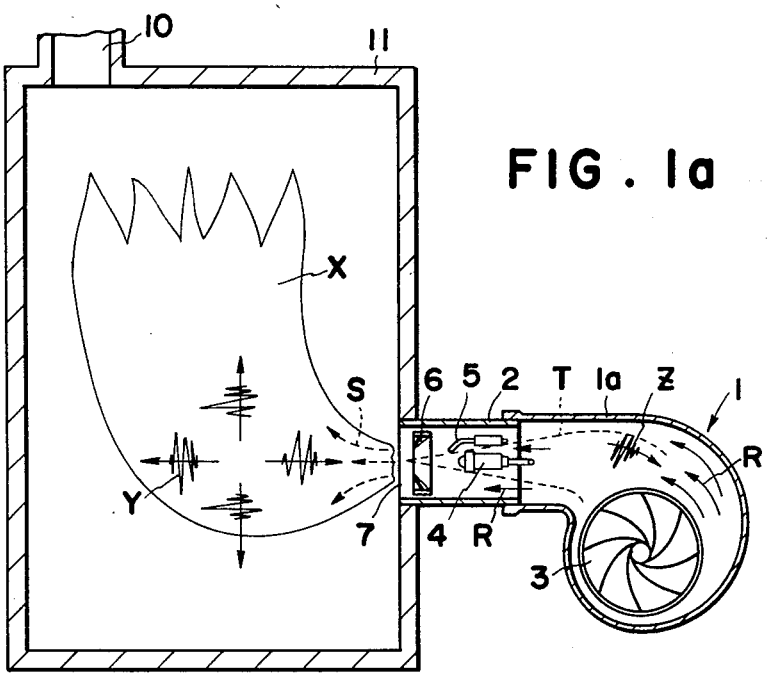
FIG. 1(*a*) and FIG. 1(*b*) are longitudinal sectional view and transversal plan view, respectively, of a burner assembly fixed to a combustion housing, in a first embodiment of the invention.

In the drawings, like reference numeral represent like parts of the burner assembly, and the direction of supply of a combustion air, the direction of issuing of air-fuel mixture particles, pneumatic oscillations due to combustion flame and combustion sound and direction of progress of the waves are indicated by sumbols, "R," "S," etc.

Figure 1B:
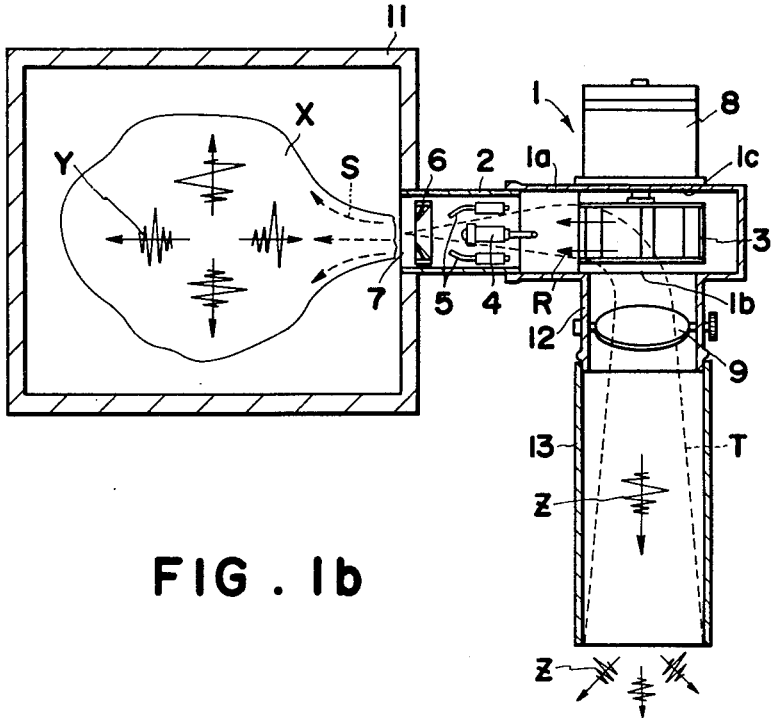

Referring to the first embodiment shown in FIGS. 1(*a*) and 1(*b*), a burner body 1 is fixed to a combustion housing 11 of a furnace at a fuel inlet 7 through a fuel duct 2. The housing 11 has a gas outlet 10 at its upper portion. Disposed within the burner body 1 and the fuel duct 2 are such principal mechanism of the burner as a fan 3, a fuel nozzle 4, an ignition rod 5 and an air-fuel mixture diffuser 6. As shown in the drawings, the air-fuel mixture diffuser 6 is disposed between the elements 4, 5 and the fuel inlet 7 but closely adjacent to the inlet 7. The burner body has a casing 1*a* which has an inlet 1*b* opposite to the closed side 1*c* thereof. Outside the closed side of the casing 1*a* is disposed a motor 8 which is mechanically connected with the fan. An intake damper 9 is disposed within a sleeve 12 which is communicated with the opened side, namely, the inlet 1*b* of the casing. It is preferred that the casing 1*a* and sleeve 12 are of integral structure. An air duct 13 made of a desired metal such as steel, or of a desired plastics is connected to the sleeve 12 with its other end 14 being opened.

Figure 2:
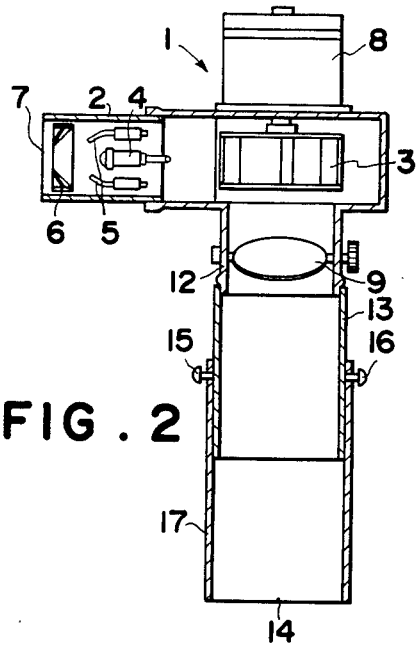
FIG. 2 is a transversal plan view of a burner assembly according to a second embodiment of the invention.

In the embodiment shown in FIG. 2, a cylindrical member 17 is removably connected by set screws 15, 16 to the air duct 13. The cylindrical member 17 is made of any desired materials, such as metal or plastics.

Figure 3:
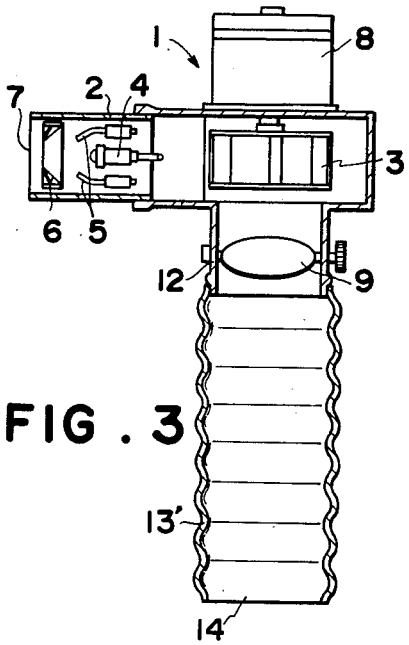
FIG. 3 is a transversal plan view of a burner assembly according to a third embodiment of the invention.

In the embodiment shown in FIG. 3, a bellows-like air duct 13' is connected to the sleeve 12 with its other end 14 being opened such that the air duct 13' may be telescoped.

Figure 4:
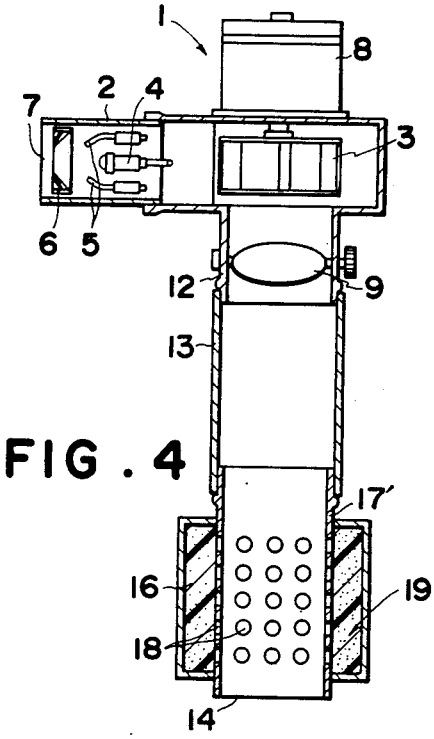
FIG. 4 is a transversal plan view of a burner assembly according to a fourth embodiment of the invention.

In the embodiment shown in FIG. 4, a cylindrical member 17' which has a plurality of small apertures 18 is connected to an air-duct 13. Around the apertured cylindrical member 17' is disposed a sound-absorbing material 16 so that the combination of the apertured member 17' with the sound-absorbing material 16 form a silencer device 19.

Figure 5:
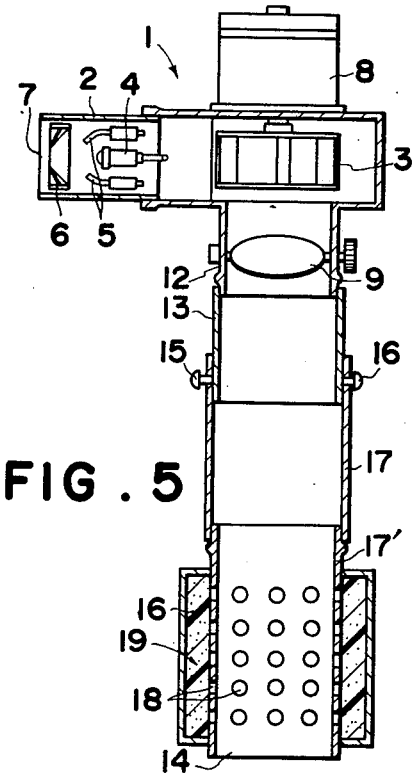
FIG. 5 is a transversal plan view of a burner assembly according to a fifth embodiment of the invention.

In the embodiment shown in FIG. 5, a silencer device 19, which is quite same as that of the embodiment of FIG. 4, is connected to a cylindrical member 17 which is removably connected to an air duct 13. The construction of the air duct 13 and the cylindrical member 17 is same with that of FIG. 2. If necessary, a desired sound absorbing material may be disposed on the inner surface of the cylindrical or bellows-like air duct 13, 13' illustrated in FIGS. 1 through 5.

In the embodiments shown in FIGS. 2 and 5, there is provided an outer cylindrical member 13' which surrounds the air duct 13. The outer cylindrical member 13' is of an adjustable length and is secured by set screws 15 to the air duct 13. Therefore, the air duct 13 is telescoped by means of the outer cylindrical member 13' in function.

In the embodiment shown in FIG. 3, the air duct 13 is of bellows-like structure. In this embodiment, the length of the air duct 13 is made adjustable in accordance with main pneumatic oscillation frequencies including center frequency of pneumatic oscillations at complicated frequencies (Y) due to combustion sound within the housing 11 of the furnace, the combustion sound varying with various conditions such as fuel, furnace temperature and fun.

In the other embodiments shown in FIGS. 4 and 5, a combustion sound at frequencies other than the main pneumatic frequencies, which include center frequency directly propagating from the open end 14 into the room where the burner is installed, is absorbed, so that it is possible to obtain extreme effects of prevention of a combustion sound.

With the above construction of the burner assembly according to the present invention, pneumatic oscillations (Y), which are generated at complicated frequencies due to a combustion sound developed within the housing 11 when air-fuel mixture particles are issued into the housing 11 (as indicated by an arrow S) and form a flame (X) by combustion, proceed from the fuel inlet 7 through the fuel duct 2 and furnace body 1, that is, pass through the diffuser 6, nozzle 4, ignition rod 5 and fan 3. Thus, the pneumatic oscillations are rendered into pneumatic oscillation plane progressive waves (Z), which proceed from the inlet 8 into the air duct 13 and are propagated into an atmosphere through the open end 14. Since the aforementioned path, that is, the path from the fuel inlet 7 to the open end 14 of the air duct 13, is constituted by an air duct mechanism of a suitable length, pneumatic oscillation plane progressive wave of a resonant frequency peculiar to the length of the air duct mechanism is reflected at the boundary where the wave is converted into a pneumatic oscillation spherical progressive wave toward an atmosphere, and the plane reflected wave and plane progressive wave overlap each other to produce violent oscillation, that is, for conversion into pneumatic oscillation plane stationary wave (T) having a "node" at the closed end of the fuel inlet 7 and "loop" at the open end 14.

More particularly, since the burner assembly of the present invention comprises an air duct 13 which is provided at the inlet 8 of the fan 3 and constitutes an air duct mechanism or an air passage, of the desired length to cause resonation of waves of main oscillation frequencies which contain a center frequency among pneumatic oscillations (Y) at complicated frequencies due to combustion sound grown within the housing 11 of the furnace, plane progressive waves of main frequencies which contain a center frequency among pneumatic plane progressive waves (Z) proceeding in the direction opposite to the direction of supply of combustion air (R) are converted into pneumatic oscillation plane stationary waves (T) to extremely and desirably reduce progressive energy of the pneumatic oscillation plane progressive waves (Z) for preventing various adverse effects upon the operation of the burner mechanism of the burner body 1, thus completely precluding or eliminating the aforesaid drawbacks which are inherent in the conventional prior art burners such as flashback phenomenon, breathing combustion, the necessity for large size and high pressure fan and an increase of the burner size.

Furthermore, since the pneumatic oscillation plane stationary wave (T) resonates violently within the air duct 13 of the burner assembly, it is converted into heat energy due to friction caused by an active movement of the air particles and is hence gradually attenuated with the lapse of time. Thus, it is possible to realize a burner having various advantages such as freedom from resonance at doors or windows of the room where the burner assembly is installed, steady and complete combustion with low combustion sound, low air supply pressure for reduction of energy and reduction of burner size.

Figure 6:
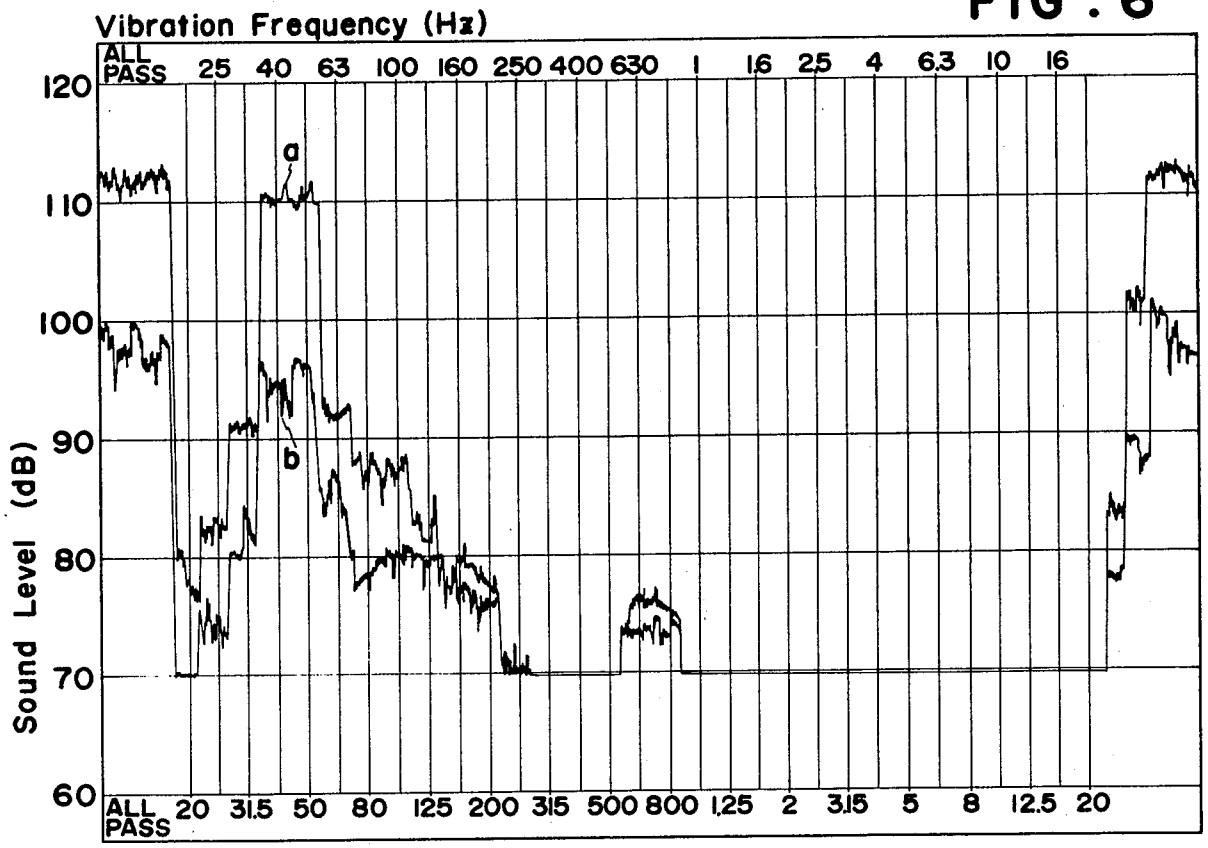
FIGS. 6, 7 and 8 show data obtained through $\frac{1}{3}$ octave band analysis of pneumatic oscillations due to combustion sound in case where an oscillatory combustion is eliminated with the burner assembly of the first embodiment shown in FIGS. 1(*a*) and 1(*b*)
Figure 7:
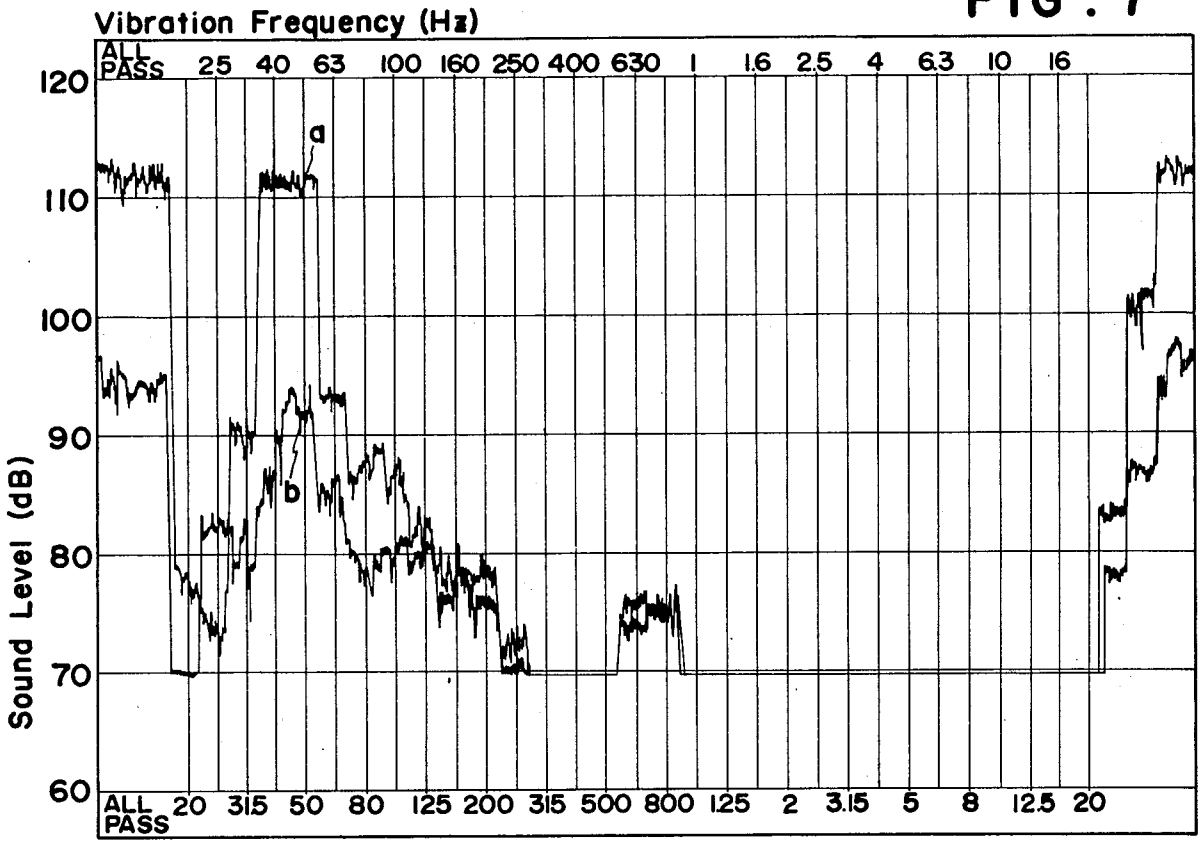
Figure 8:
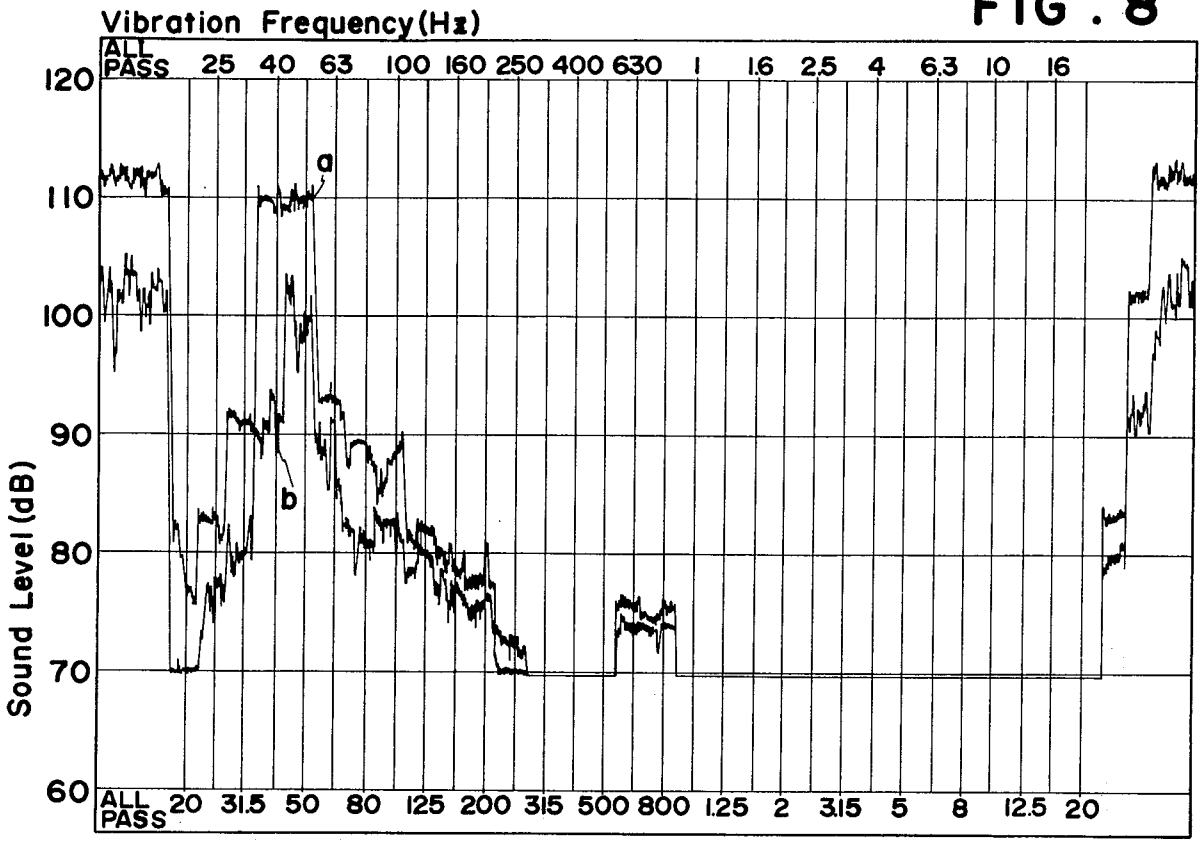

Now, the length of the air duct 13 and air duct mechanism featured by the invention will be discussed. FIGS. 6, 7 and 8 compare data obtained through $\frac{1}{3}$ octave band analysis of pneumatic oscillations due to combustion sound in case where oscillatory combustion is actually caused by providing the prior-art burner (symbol a) and cases where the oscillatory combustion is eliminated by varying the length of the air duct 0.15 meter in inner diameter, which is provided in the burner of the first embodiment of the invention, to 0.8 meter (symbol b in FIG. 6), 1.6 meter (symbol b in FIG. 7) and 2.4 meter (symbol b in FIG. 8) respectively.

Figure 9:
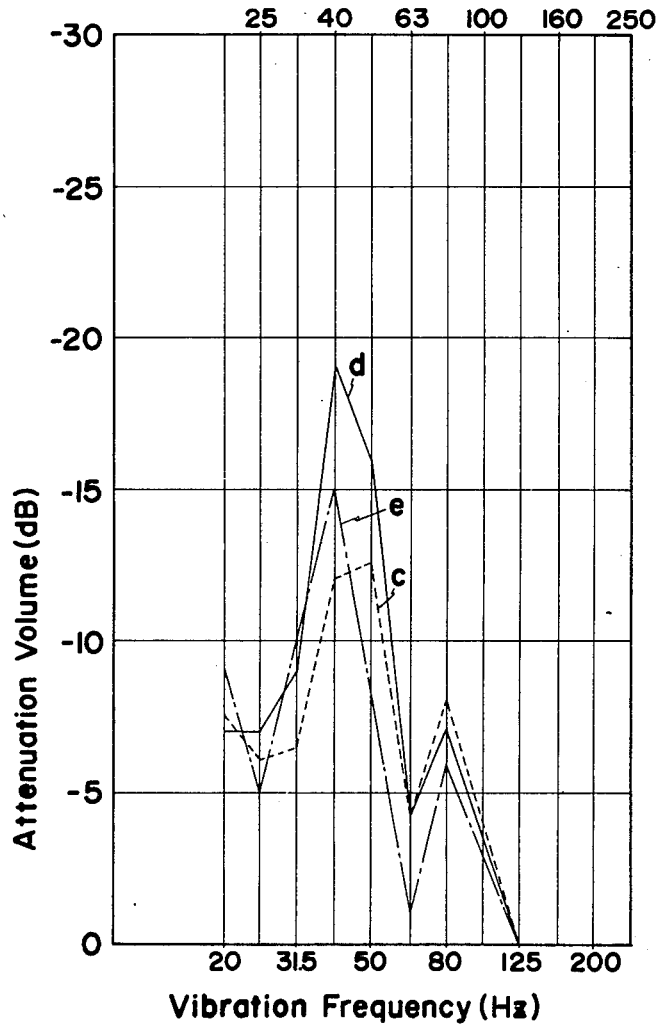
FIG. 9 shows data about the attenuation of pneumatic oscillation in cases of FIGS. 6, 7 and 8.

FIG. 9 shows data about the fact that the effects according to the invention are pronounced, with the difference between the levels of symbols a and b shown in FIGS. 6, 7 and 8, that is, the attenuation of the pneumatic oscillations with the burner of the first embodiment according to the invention, being represented by respective symbols c, d and e.

The afore-mentioned data indicates that the most pronounced effects according to the invention can be obtained in case where the air duct constituting the mechanism feature of the invention has a length of 1.6 meter.

Figure 10:
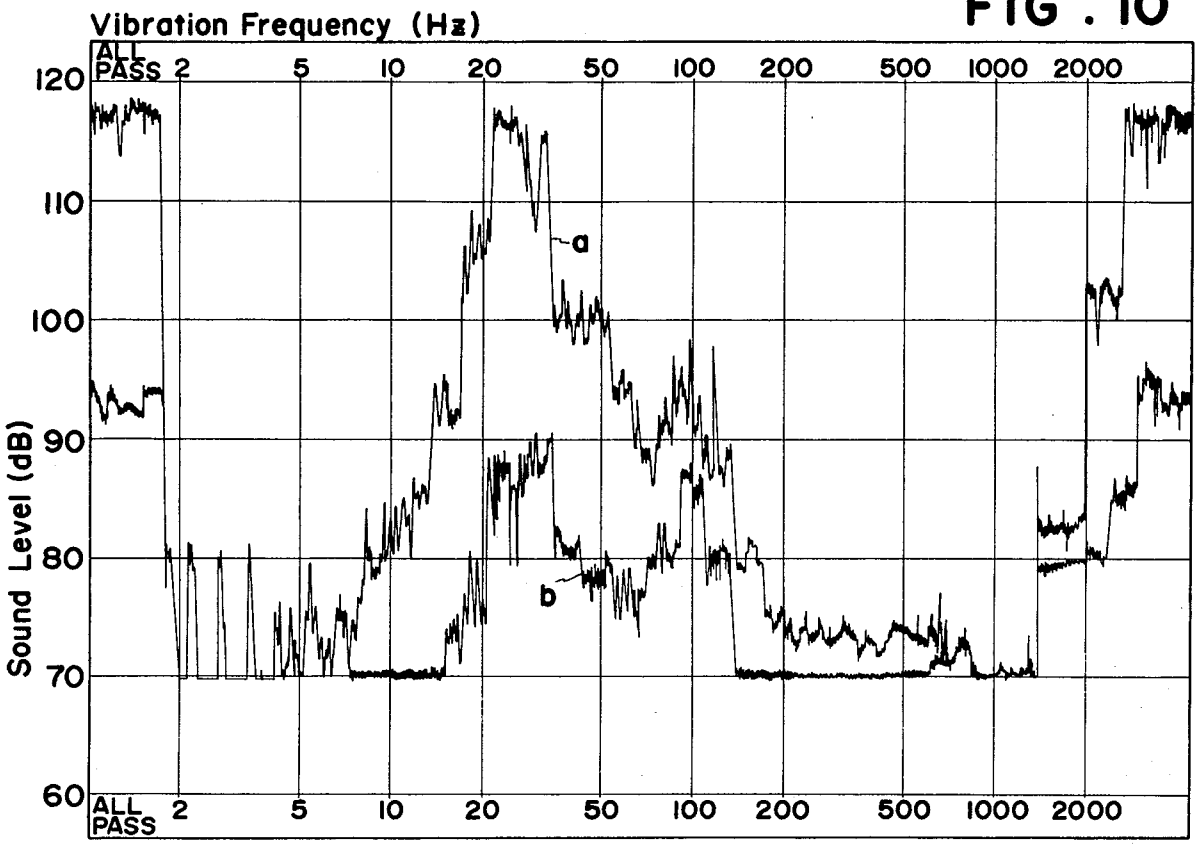
FIG. 10 shows data obtained through experiments similar to those of FIGS. 6, 7 and 8, conducted with a vertical-type boiler.

FIG. 10 shows data obtained by similar experiments conducted with a vertical boiler. The most pronounced effect is obtained in case where the air duct has a length of 2.7 meters. In FIG. 10, symbol a indicates the case where the conventional burner is provided, and symbol b shows where the burner of the first embodiment of the invention is provided.

It will be understood from the data of FIGS. 6, 7 and 8 and also the data of FIG. 10 that since the center frequency of pneumatic oscillations due to the combustion sound in the individual cases is substantially 47 Hz and 25 Hz, the length of the air duct that has shown the most pronounced effects in these experiments meet the theoretic value of the resonant air duct.

While the center frequency of the pneumatic oscillation due to the combustion sound varies with various conditions such as a burner fuel inlet, shape and dimensions of the furnace, combustion temperature and external ambient temperature, it may usually be thought to be within a range of 20 to 200 Hz.

It will further be seen from the experiments of FIGS. 6 to 8 and also from FIG. 9 that the length of the air duct according to the invention may range from 0.4 to 4.0 meters in practice since pronounced effects can be expected, although they may vary to some extents, even if the length corresponding to the center frequency of the pneumatic oscillation due to the combustion sound is slightly deviated. Further, regarding the sectional profile, extremely superior effects can be obtained with circuler or regular polygon form compared to the elliptical or rectangular form.

What is claimed is:

1. A burner assembly connected with a combustion chamber at a fuel inlet of said combustion chamber comprising:

a fuel duct having a first end connected to said fuel inlet and a second end spaced from said first end, said fuel duct containing therein a fuel injection nozzle, ignition rod and air-fuel mixture diffuser;

a blower means having an inlet for receiving air and an outlet for blowing received air into said second end of said fuel duct, the air blown into said fuel duct passing through said fuel duct into said combustion chamber; and a generally cylindrical conduit member coupled to said inlet of the blower means and extending axially away from said inlet, said generally cylindrical conduit member having a length of about 0.8m to about 2.7m, whereby pneumatic oscillation plane progressive waves are converted into plane stationary waves to thereby reduce progressive energy of said pneumatic oscillation plane progressive waves.

2. A burner assembly as claimed in claim 1 wherein said conduit member has an adjustable length.

3. A burner assembly as claimed in claim 1, wherein said burner assembly further comprises an additional tubular member telescopically connected with said conduit member.

4. A burner assembly as claimed in claim 1 wherein a sound absorption material is disposed on the interior of said conduit member.

5. A burner assembly connected with a combustion chamber at a fuel inlet of said combustion chamber comprising:

a fuel duct having a first end connected to said fuel inlet and a second end spaced from said first end, said fuel duct containing therein a fuel injection nozzle, ignition rod and air-fuel mixture diffuser;

a blower means having an inlet for receiving air and an outlet for blowing received air into said second end of said fuel duct, the air blown into said fuel duct passing through said fuel duct into said combustion chamber; and an adjustable conduit member coupled to said inlet of the blower means and extending axially away from said inlet, said conduit member having a bellows-like construction and a length variable between 0.8m and 2.7m, whereby pneumatic oscillation plane progressive waves are converted into plane stationary waves to thereby reduce progressive energy of said pneumatic oscillation plane progressive waves.

* * * * *